US005722102A

United States Patent [19]

Summers

[11] Patent Number: 5,722,102

[45] Date of Patent: Mar. 3, 1998

[54] BACKREST DEVICE

[76] Inventor: Neil Summers, 63 New Inn Lane, Guildford, Surrey GU4 7HT, United Kingdom

[21] Appl. No.: 669,527

[22] PCT Filed: Jan. 26, 1995

[86] PCT No.: PCT/GB95/00155

§ 371 Date: Jul. 10, 1996

§ 102(e) Date: Jul. 10, 1996

[87] PCT Pub. No.: WO95/20897

PCT Pub. Date: Aug. 10, 1995

[30] Foreign Application Priority Data

Feb. 4, 1994 [GB] United Kingdom ..... 9402167

[51] Int. Cl.[6] ..... A47C 20/02

[52] U.S. Cl. ..... 5/630; 297/452.29; 297/452.31; 297/452.45

[58] Field of Search ..... 297/452.29, 452.3, 297/452.31, 452.32, 452.45, 630, 632

[56] References Cited

U.S. PATENT DOCUMENTS

| | | | |
|---|---|---|---|
| 2,152,734 | 4/1939 | Ford | 5/630 X |
| 2,620,862 | 12/1952 | Hite | 297/452.45 |
| 3,145,054 | 8/1964 | Sopko | 297/452.3 |
| 3,713,696 | 1/1973 | Dudley | 297/452.32 X |
| 4,189,182 | 2/1980 | Rhoe . | |
| 4,210,134 | 7/1980 | Okazaki et al. | 5/630 X |
| 4,383,342 | 5/1983 | Forster | 297/452.32 X |
| 4,529,248 | 7/1985 | Trotman et al. | 297/452.45 |
| 4,572,578 | 2/1986 | Perkins | 297/452.32 |
| 4,744,351 | 5/1988 | Grundei et al. | 5/630 X |
| 5,328,245 | 7/1994 | Marks . | |

FOREIGN PATENT DOCUMENTS

| | | | |
|---|---|---|---|
| 0 036 158 | 9/1981 | European Pat. Off. . | |
| 2634119 | 1/1990 | France | 5/630 |
| 9303800 | 5/1993 | Germany . | |

*Primary Examiner*—James R. Brittain
*Assistant Examiner*—David E. Allred
*Attorney, Agent, or Firm*—Baker & Daniels

[57] ABSTRACT

A backrest device having a supporting surface presenting two elongate continuous or discontinuous protuberances which extend alongside one another and are arranged to engage the back of a person, resting in use against the supporting surface, on each side of the spine, with a channel between the protuberances to accommodate the bony part of the spine with substantially no pressure on the bony part of the spine.

21 Claims, 3 Drawing Sheets

BACKREST DEVICE

Figure 1:
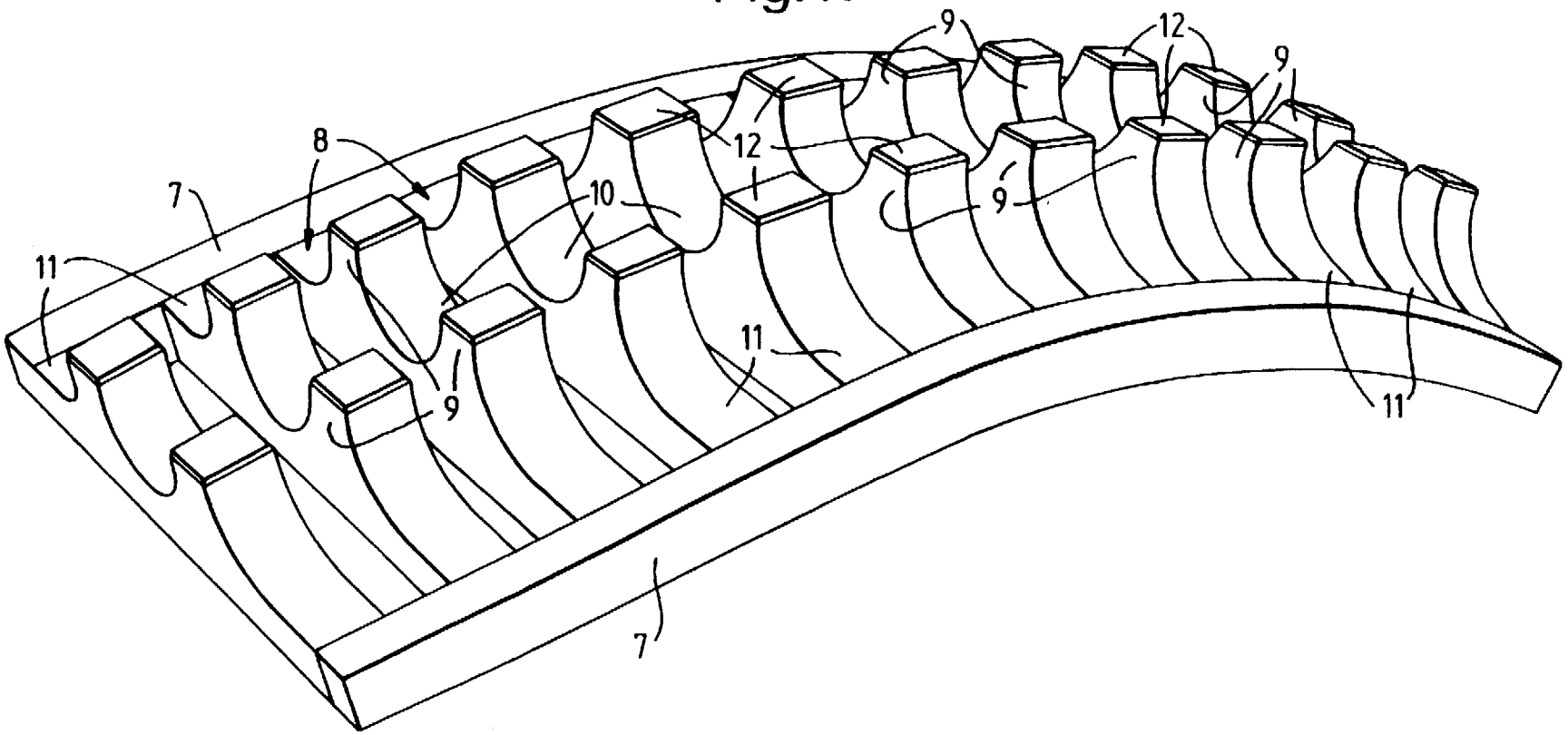

The invention is concerned with a backrest device providing a supporting surface for the back of a person sitting against, or lying on, the device. Such devices have a variety of uses, such as for posture correction in clinics, for relaxation after workout in fitness clubs, or for personal pain relief at home or in the car.

The supporting surface of a conventional backrest device typically consists of a series of longitudinally spaced transversely extending slats. Because the slats are flat, they provide firm, potentially damaging, and often uncomfortable, contact with the bony part of the spine, and insufficiently firm contact with the muscular tissue on each side of the spine, which would be desirable to relax those muscles.

In accordance with the present invention, a backrest device has a supporting surface presenting two elongate continuous or discontinuous protuberances which extend alongside one another and are arranged to engage the back of a person, resting in use against the supporting surface, on each side of the spine, with a channel between the protuberances to accommodate the bony part of the spine with substantially no pressure on the bony part of the spine. The protuberances will normally be raised with respect to lateral portions of the supporting surface to the sides of the protuberances remote from the channel.

This construction is beneficial and comfortable in that, when a person relaxes against, and conforms to the shape of, the supporting surface, the vertebrae forming the bony part of the spine are effectively suspended within the channel, the body weight being supported on the protuberances and possibly also on the lateral portions of the supporting surface. In this configuration the vertebrae can be stretched or adjusted relatively to one another without local pressure from the supporting surface. However, the protuberances provide localized pressure on the muscular tissue on each side of the vertebrae, which is also beneficial for relieving deep seated muscular tension. The maximum width of the channel, between the extremities of the protuberances, will normally be between 3 and 20 cm, preferably substantially 5 cm, and the depth of the channel at least 2 cm.

When discontinuous, each protuberance may be formed by a row of knobbles, which will maximize the localized pressure. The knobbles in the two rows are preferably in transverse alignment with one another and will usually be spaced at centres along each row corresponding to the average distance between centres of adjacent healthy vertebrae, i.e. between 3.5 and 4.5 cm. It is then possible for a person resting against the supporting surface to adjust his position along the rows until a comfortable position is found at which each vertebra of at least a short series of vertebrae, are similarly positioned relatively to corresponding pairs of knobbles, one on each side of the channel. For clinical use, involving the treatment of, e.g., fused or crushed vertebrae, the knobbles may be at larger centres, of up to 7 cm or more.

The extreme, body-engaging surfaces of the knobbles preferably each presents no more than a surface area of 5 sq.cm., and a dimension, in the direction parallel to the rows, of between ½ and 2 times the dimension thereof in the transverse direction.

In the nominal longitudinal direction, i.e. parallel to the lengths of the protuberances (i.e. parallel to the rows of knobbles when provided), the supporting surface may be of concave, flat, or convex shape, depending upon the intended use. All three shapes are appropriate for physio-therapeutic use in the treatment of patients suffering from spinal deformation such as ankylosing spondylitis. Thus a patient in an advanced state of the disease, and with a severely hunched back may need to be treated initially with a device having a concave supporting surface, the curvature of which is less than that of the patient's back. Less disabled patients, or newly diagnosed patients with the condition, may be treated with a device having less concave or a flat or even convex curvature. There will then be use for a universal device having a varying curvature along its length, perhaps with a concave section at one end passing through a point of inflexion to a convex section at the other end. Both concave and convex curvatures may be involute like in that the curvature increases in one longitudinal direction. This is particularly appropriate for a convex section as a persons back laid against the supporting surface would usually be more mobile at the neck end so that the device could be used with the trunk resting against a portion of the convex supporting surface of small curvature which increases to one end which is intended to support the neck. Moving of the body in one direction or the other along the varying curve of the supporting surface also enables each person to adopt a relative position at which the desired degree of flexure of the spine, for example full arched back extension over a convex section, can be achieved.

A simple, cheap and readily portable version of the device for relaxation or callisthenic purposes may consist essentially of a straight or slightly convexly curved section, extending substantially two thirds of the length of the device, and leading into a shorter section of greater curvature.

The actual construction of the device is unimportant provided that it is sufficiently rigid to withstand the pressure from a body, particularly the weight of a person's body if it is to be used with the person lying supine. The protuberances when discontinuous, may be provided by an appropriately shaped series of longitudinally spaced cross members secured at their ends to longitudinal side pieces. Alternatively, the protuberances could be formed integrally with a single member forming the supporting surface, for example by a moulding technique. The supporting surface could be made of any suitable material, such as wood, metal, or a plastics material and at present reinforced foamed plastics material appears to be most suitable.

Figure 2:
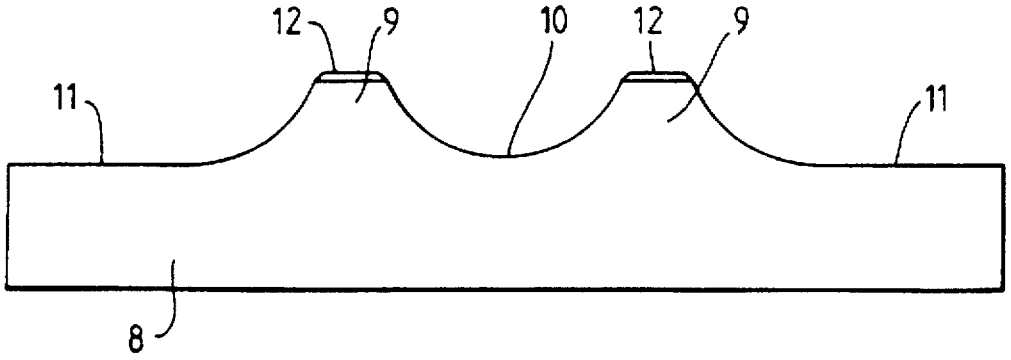
Figure 5:
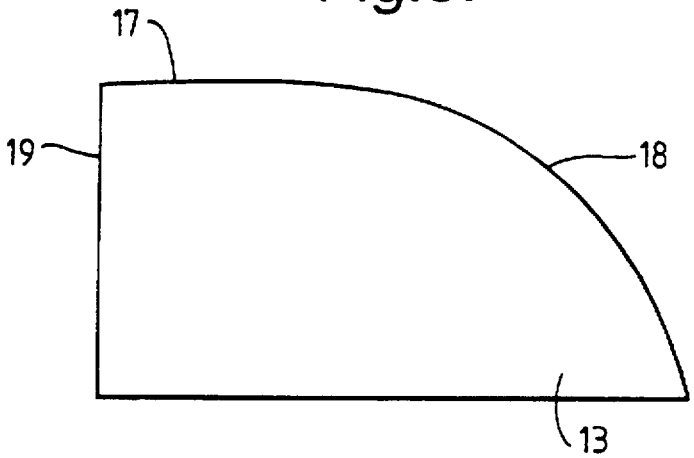
Figure 6:
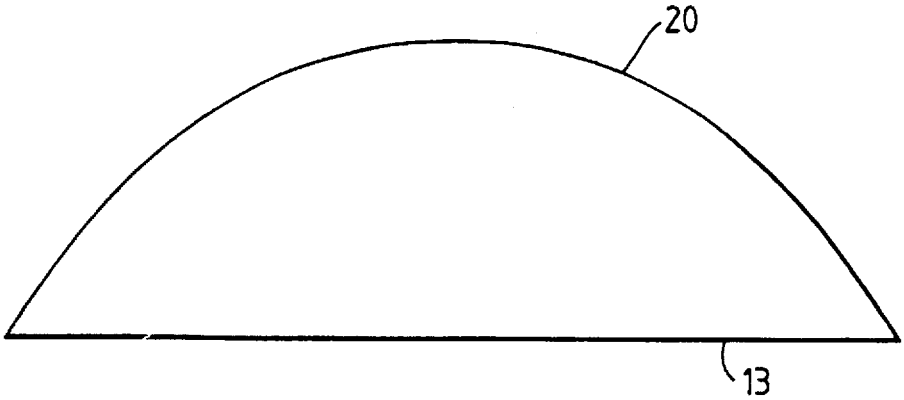
Figure 3:
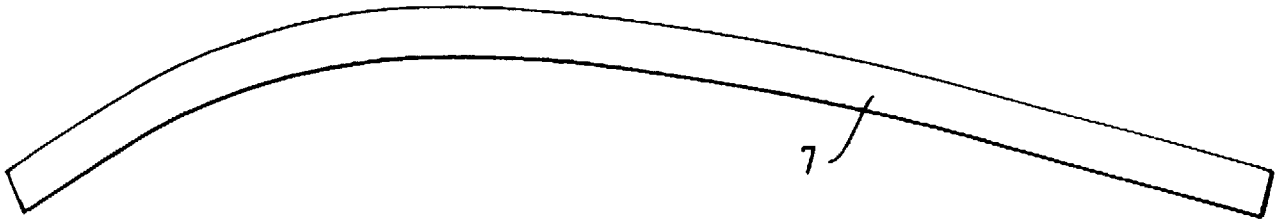
Figure 4:
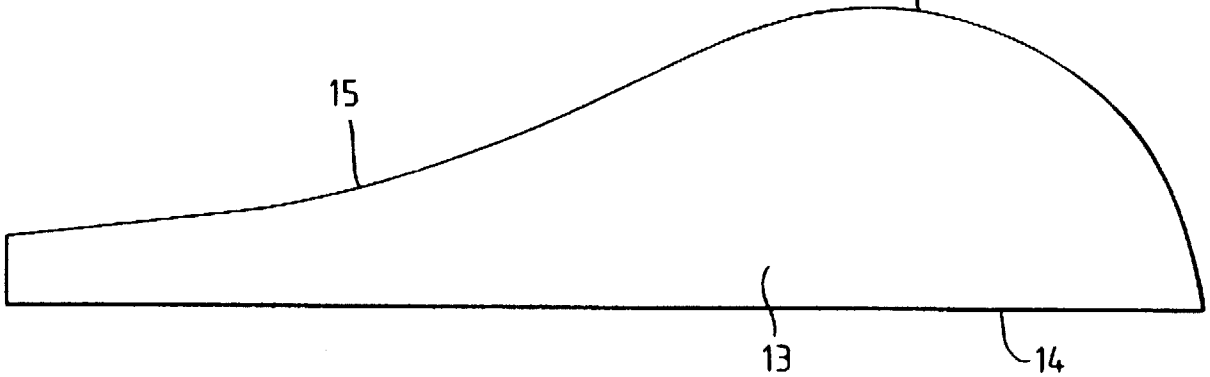

Some examples of devices constructed in accordance with the present invention are illustrated in the accompanying drawings, in which:

FIG. 1 is a perspective view of part of a supporting surface of one device,

FIG. 2 an elevation of one cross member of the supporting surface,

FIG. 3 an elevation of one side rail of the first device and,

FIGS. 4, 5 and 6 are diagrammatic side of the three other devices.

The device shown in FIGS. 1 to 3 has two longitudinally extending curved side rails 7 which are upwardly convex and the curvature of which increases towards one end. As shown in FIG. 1 the two side rails are rigidly interconnected by a series of similar cross members 8 the elevation of each of which is shown in FIG. 2. Each cross member presents, raised above the upper edges of the side rails 7, a pair of knobbles 9 separated by a semi-circular recess 10. To the side of each knobble 9 remote from the recess 10, each cross member presents a supporting portion 11. Each knobble 9 has an upper extremity presenting a substantially square body-supporting surface 12, the edges of which are chamfered.

As will be appreciate from FIG. 1, the recesses 10 define the envelope of a channel between the two rows of knobbles 9, to accommodate the bony part of the spine, while the surfaces 12 of the knobbles 9 support the muscular tissue on each side.

The supporting portions 11 and the upper edges of the rails 7 provide additional support for the sides of the user's back, and surfaces to be engaged by the user's hands as the trunk is lowered onto the supporting surface.

In the illustrated example, the surfaces 12 are approximately 2 cm by 2 cm, the cross members 8 are positioned on 4 cm centres along the device, the recess 10 is 2 cm deep, and the maximum width of the recess 10 is 7.5 cm.

The developed length of the supporting surface of this device is approximately 55 cm, its maximum height from the ground 10 cm, and its width 25cm.

The device of FIGS. 1 to 3 may be used upright with the end of greater curvature lowermost to form the back of a chair to support a person in the sitting position. Alternatively it may be used with the ends of the rails 7 resting on the floor, in which case the device would be used to support a supine body draped backwards over the supported surface with the head at the end of greater curvature.

Whereas the device of FIGS. 1 to 3 is lightweight and portable and for personal use, FIG. 4 shows in side elevation a larger device for universal use, for example for therapeutic use in a clinic. It consists of two side panels 13 having straight lower edges 14 for resting on the floor. The side panels are rigidly interconnected by a series of cross members 8, similar to those shown in FIGS. 1 and 2. For simplicity the knobbles 9 are not shown projecting above the upper curved edge of the panel 13 in FIG. 4. However the upper curved edge shows that the supporting surface has a concave section 15 merging into a convex section 16, the curvature of which increases in a direction away from the concave section. A patient may lie on any portion of the surface depending upon his condition. In this example the cross members have the same dimensions and spacing as in the examples of FIGS. 1 to 3 but the supporting surface has a developed length of 125 cm, a width of 38 cm and a maximum height of 39 cm.

FIGS. 5 and 6 show modifications of the FIG. 4 example, constructed in a similar manner but with different curvature and dimensions. Thus the device shown in FIG. 5 has a supporting surface with a horizontal section 17 merging into a convex downwardly sloping section 18. This device is intended to be used with the patient lying supine, with his legs hanging over the front edge 19 of the device, the weight of the legs providing a degree of traction on the spine. In this case the supporting surface 17, 18 has a developed length of 150 cm, a width of 38 cm and a maximum height of 60 cm.

The FIG. 6 example differs from the FIG. 5 example in that the supporting surface presents a continuous convex curvature 20 as seen in the side elevation of FIG. 6. This device, which has a developed length of 150 cm, a width of 38 cm and a maximum height of 75 cm, can be used to provide maximum arched extension of the back.

I claim:

1. A backrest device having an upwardly facing supporting surface which is arranged to engage the back of a person lying supine in use on the supporting surface, the surface being convexly curved upwardly along a longitudinal direction and being substantially rigid to thereby withstand the weight of the person's body, and the surface presenting two rows of knobbles extending alongside one another in the longitudinal direction for engaging the person's back on each side of the spine, with a channel between the rows of knobbles to accommodate the bony part of the spine with substantially no pressure on the bony part of the spine, the knobbles comprising discrete knobs separated by spaces in the longitudinal direction.

2. A device according to claim 1, in which the knobbles are raised with respect to lateral portions of the supporting surface to the sides of the rows of knobbles remote from the channel.

3. A device according to claim 1, in which the maximum width of the channel, between the extremities of the knobbles, is between 3 and 20 cm.

4. A device according to claim 3, in which the maximum width of the channel, between the extremities of the knobbles, is substantially 5 cm.

5. A device according to claim 1, in which the depth of the channel is at least 2 cm.

6. A device according to claim 1, in which the knobbles in the two rows are in transverse alignment with one another.

7. A device according to claim 1, in which the knobbles in the two rows are spaced at centres along each row up to substantially 7 cm.

8. A device according to claim 7, in which the knobbles in the two rows are spaced at centres along each row between 3.5 and 4.5 cm.

9. A device according to claim 1, in which the extreme, body-engaging surfaces of the knobbles each presents no more than a surface area of 5 sq.cm.

10. A device according to claim 1, in which the extreme, body engaging surfaces of the knobbles each presents a dimension, in the longitudinal direction which is parallel to the rows, of between ½ and 2 times the dimension thereof in the transverse direction.

11. A device according to claim 1, in which the convex curvature of the supporting surface in the longitudinal direction increases towards an end of the device.

12. A device according to claim 1, which comprises a pair of longitudinal side rails and a series of longitudinally spaced cross members having opposite ends, the cross members secured at their opposite ends to the longitudinal side rails, the cross members being shaped to provide the knobbles.

13. A device according to claim 2, in which the maximum width of the channel, between the extremities of the knobbles, is between 3 and 20 cm.

14. A device according to claim 2, in which the depth of the channel is at least 2 cm.

15. A device according to claim 3, in which the depth of the channel is at least 2 cm.

16. A device according to claim 4, in which the depth of the channel is at least 2 cm.

17. A device according to claim 2, in which the knobbles in the two rows are in transverse alignment with one another.

18. A device according to claim 3, in which the knobbles in the two rows are in transverse alignment with one another.

19. A device according to claim 4, in which the knobbles in the two rows are in transverse alignment with one another.

20. A device according to claim 5, in which the knobbles in the two rows are in transverse alignment with one another.

21. A device according to claim 1 wherein the convexity of said surface gradually changes along the longitudinal direction.

* * * * *